US005419111A

United States Patent [19]

Wassenhoven et al.

[11] Patent Number: 5,419,111

[45] Date of Patent: May 30, 1995

[54] SPINNING STATION WITH OPERABLE COVE FOR A ROTOR SPINNING MACHINE

[75] Inventors: Heinz-Georg Wassenhoven, Mönchengladbach; Manfred Lassmann, Nettetal, both of Germany

[73] Assignee: W. Schlafhorst AG & Co., Moenchengladbach, Germany

[21] Appl. No.: 208,623

[22] Filed: Mar. 8, 1994

[30] Foreign Application Priority Data

Mar. 26, 1993 [DE] Germany ..... 43 09 947.5

[51] Int. Cl.[6] ..... D01H 4/00

[52] U.S. Cl. ..... 57/407; 57/100; 57/412

[58] Field of Search ..... 57/406, 407, 408, 412, 57/100

[56] References Cited

U.S. PATENT DOCUMENTS

| | | | |
|---|---|---|---|
| 3,975,894 | 8/1976 | Suzuki | 57/407 |
| 4,030,279 | 3/1977 | Rambousek et al. | 57/407 |
| 4,150,530 | 4/1979 | Derichs | 57/100 X |
| 4,249,369 | 2/1981 | Tsozuki et al. | 57/100 X |
| 4,660,374 | 4/1987 | Wassenhoven | 57/407 |
| 4,769,984 | 9/1988 | Raasch et al. | 57/407 |
| 5,222,352 | 6/1993 | Stahlecker | 57/412 X |

FOREIGN PATENT DOCUMENTS

| | | | |
|---|---|---|---|
| 0385530 | 9/1990 | European Pat. Off. . | |
| 2721386 | 11/1978 | Germany . | |
| 4036017 | 7/1991 | Germany | 57/100 |

*Primary Examiner*—Daniel P. Stodola
*Assistant Examiner*—William Stryjewski
*Attorney, Agent, or Firm*—Shefte, Pinckney & Sawyer

[57] ABSTRACT

In a rotor spinning machine, each spinning station's drawing-in roller is connected directly to its own individual drive supported by the cover of the spinning station housing, which provides a simplified and conveniently accessible alternative to the conventional worm gear driving of the drawing-in rollers of the machine's plural spinning stations from a common drive shaft.

5 Claims, 5 Drawing Sheets

SPINNING STATION WITH OPERABLE COVE FOR A ROTOR SPINNING MACHINE

BACKGROUND OF THE INVENTION

The present invention relates to the rotor spinning of textile yarns and, more particularly, to rotor spinning machines of the type having a plurality of simultaneously operated spinning stations each equipped with a driven spinning rotor, a driven sliver opening roller, and a driven drawing-in roller for feeding sliver to the opening roller, all of which are installed in a housing of the spinning station having an openable lid or cover to provide access to the functional parts.

Conventionally, sliver is fed to the opening rollers at the spinning stations of rotor spinning machines via drawing-in rollers at each station, each drawing-in roller being connected via a worm gear to a common drive shaft extending along the entire spinning machine. Driving of the drawing-in rollers in this manner is known from published, non-examined German Patent Application DE-OS 27 21 386. If the yarn or sliver breaks, and during piecing up operations, the drawing-in roller is disconnected from the drive shaft by actuation of a coupling. Driving all the drawing-in rollers along one side of the spinning machine with a common drive shaft, and the provision of a coupling for each drawing-in roller, requires a considerable engineering expense and does not allow for individualized feeding of the slivers to be adjustably adapted to particular circumstances at the spinning stations.

SUMMARY OF THE INVENTION

It is therefore an object of this invention to provide a structurally simplified embodiment for driving the operational components of a spinning station in a rotor spinning machine. In accordance with the present invention, this objective is attained by connecting each drawing-in roller at each spinning station to its own individual drive which is supported by the cover of the housing of its respective spinning station. Typically, the housing cover at a conventional rotor spinning station is supported in hinged fashion at the front of the spinning station. Thus, this manner of installation to the cover of the spinning station makes the drawing-in roller and its drive directly accessible for maintenance work when the spinning station housing is opened.

Individual drives advantageously economize on couplings and step-up gears. Gears and especially couplings are subject to wear, which can result in loosened connections and slippage causing inaccurate sliver feeding. This has an especially disadvantageous effect when a yarn is being spliced or otherwise pieced up, if the quantity of sliver fed in is uneven. Specifically, any looseness or slippage in the mechanically meshing components of a conventional drive can affect the mechanical coupling between a splicing or piecing-up carriage and the drawing-in roller during a yarn piecing operation and, in turn, cause inaccurate sliver feeding.

According to a further feature of the invention, the individual drive of each drawing-in roller is a stepping motor. Advantageously, stepping motors can be started from any position without slippage. As a general rule, the stepping motor is connected to a control unit, which by digital signal processing of appropriate sensors present at each spinning station is also capable of performing digital control of sliver feeding. This makes it possible to perform individualized feeding of each sliver that is adapted to the particular situation prevailing at the spinning stations.

In accordance with a further aspect of the invention, each opening roller is similarly connected by its drive shaft to the drive shaft of an individual drive, which is also supported by the cover of the housing of its respective spinning station. Under this drive concept, the conventional rigid drive of all the opening rollers on one side of a spinning machine may be replaced by the option of individual drives which, in turn, may be adapted to the particular operating situation at a spinning station.

Under a further feature of the invention, the individual drive of each opening roller is a driven motor, e.g., an electric motor of the type having an outer driven rotor, the opening roller being in the form of a ring of card clothing on the outer circumference of the rotor. Electric motors of this outer rotor type are capable of installation in the component to be driven, making an especially compact design possible which is particularly advantageous in the present invention. The individualized driving of each drawing-in and opening roller of each spinning station is especially advantageous if the spinning rotor is also provided with its own individual drive. With a suitable electronic control, each spinning station then is largely autonomous so that the spinning stations can be assigned different tasks.

DETAILED DESCRIPTION OF THE PREFERRED EMBODIMENT

Figure 1:
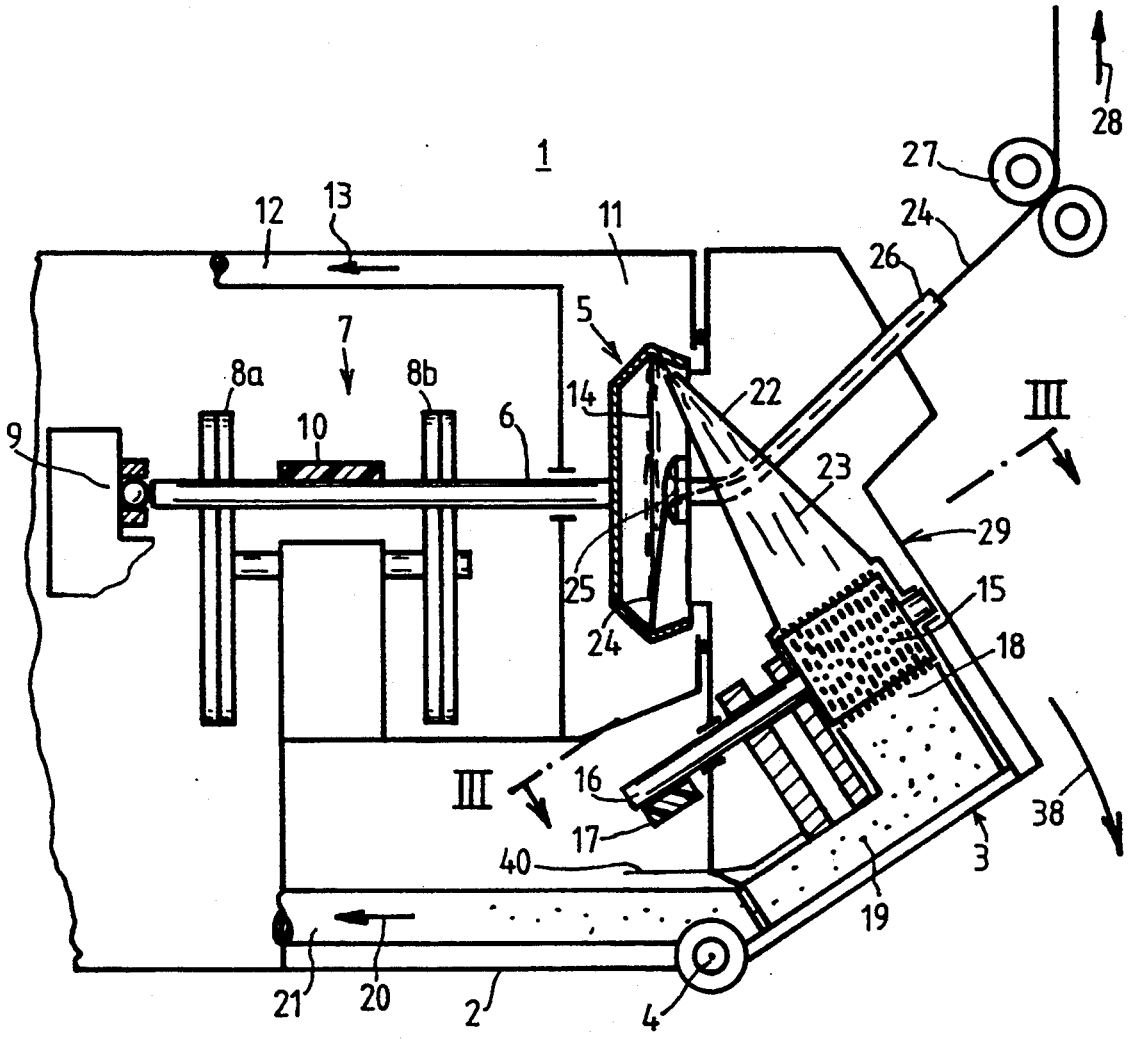
FIG. 1 is a schematic cross-section through a spinning station of a rotor spinning machine in accordance with a preferred embodiment of the present invention.

Referring now to the accompanying drawings and initially to FIG. 1, one representative spinning station 1 of a multi-station rotor spinning machine is shown schematically in section with only those features and characteristics contributing to an understanding of the present invention being shown and described.

The functional components of the spinning station 1 are enclosed within a housing 2, which is closed at its front by a cover or lid 3 which is pivotably supported in a hinge 4 on the underside of the housing 2. The main operational components of the spinning station are a spinning rotor 5, whose shaft 6 is supported rotatably for drive purposes on paired support disk bearings, of which only two bearing disks 8*a* and 8*b* have been shown as representative. The rotor shaft 6 is supported axially via a ball-type thrust bearing 9. A drive belt 10 engages the shaft 6 of the rotor 5 between the two bearing disks 8a and 8b and extends lengthwise along the entire spinning machine to drive all of the rotors of the spinning stations at one side of the machine. The arrangement of this type of twin-disk bearing for spinning rotors is already known from the prior art, such as the aforementioned DE-OS 27 21 386, and therefore need not be described in further detail herein. The manner of structural support of the rotor and its drive, which have been described earlier, are not essential to the invention. The present invention achieves its advantages equally well with directly supported rotors and especially when there is an individual drive of the rotor.

The rotor 5 rotates in a chamber 11, which communicates via a conduit 12 with a source of negative pressure (not shown), as symbolized by the arrow 13. With the aid of the negative pressure, the fibers for spinning a yarn are aspirated into the interior circumferential groove 14 of the rotor.

In the present exemplary embodiment, the functional elements required for drawing-in of a sliver, opening of the sliver into individualized fibers, feeding the separated fibers to the rotor for spinning into a yarn, and drawing off the spun yarn from the rotor are accommodated in the cover 3 of the housing 2, as shown schematically in the sectional view of FIG. 1. Specifically, a toothed opening roller 15 is rotatably supported with its drive shaft 16 in contact with a belt 17 extending longitudinally through the length of the machine as the common drive mechanism for the opening roller of each spinning station. Located below the opening roller 15 is a debris collector 18, which carries the debris 19, such as slubs, dust, foreign particles and husk residues, combed out of the sliver away to a central collecting point inside the machine by means of negative pressure, represented by the arrow 20, through a conduit 21. Located above the opening roller 15 is a fiber guide conduit 22, through which the opened fibers 23 are directed into the rotor groove 14, where they are spun into a yarn 24. The yarn 24 is removed from the housing 2 of the spinning station 1 via a yarn draw-off navel 25 through a yarn doff tube 26. Drawing off of the yarn 24 is accomplished in the direction of the arrow 28 via a pair of draw-off rollers 27. Downstream of the pair of draw-off rollers, the yarn is delivered to a winding apparatus (not shown) to form a cross-wound bobbin.

Figure 2:
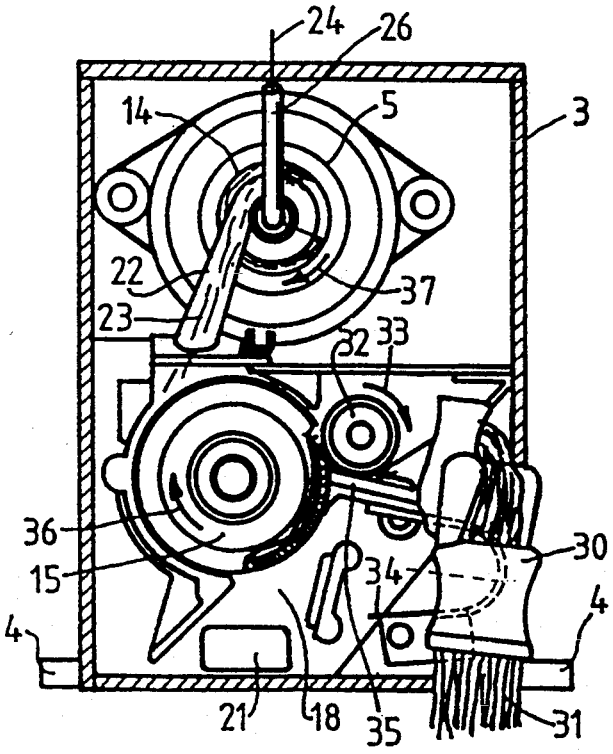
FIG. 2 is an end view of the spinning station of FIG. 1 with an end panel of the housing cover removed.

Not visible in FIG. 1 is the drawing-in roller, which is disposed adjacent the opening roller 15 and therefore is hidden by it in the view of FIG. 1. FIG. 2 therefore shows an end view of the spinning station of FIG. 1 to illustrate the primary spinning components, with the front panel 29 of the cover 3 broken away as indicated by the sectioned edge. A tubular sliver condenser 30 is mounted to the cover 3 adjacent the drawing-in roller 32 for delivering the sliver 31 through the condenser 30 to the drawing-in roller 32. The drawing-in roller 32 is driven to rotate in the direction of the arrow 33 and a sliver feed table 35 is pivotably mounted adjacent the periphery of the drawing-in roller 32 and biased thereagainst by a spring device 34. The sliver is compressed between the feed table 35 and the drawing-in roller 32 and delivered to the opening roller 15, which is driven to rotate in the direction of the arrow 36. The fibers are combed out of the sliver and thusly separated from one another. These separated fibers 23 are then fed through the fiber guide conduit 22 and into the circumferential groove 14 of the rotor 5, where they are spun into a yarn 24, as already described. The rotor 5 is driven to rotate in the direction of the arrow 37. The yarn 24 is drawn off through the yarn doff tube 26, as described.

The preferred drive mechanism for the drawing-in roller 32 is a stepping motor 39 located coaxially with the drawing-in roller and connected directly to the shaft thereof. Accordingly, as viewed in FIG. 2, the motor drive to the drawing-in roller 32 is hidden by the drawing-in roller 32 itself, but can be seen in the sectional view of FIG. 3 taken through the cover 3 along the lines III—III of FIG. 1.

As will thus be understood, the disposition of the described operational components of the spinning station 1 with the cover 3 makes them readily accessible when the cover 3 is pivoted open about the hinge 4 in the direction of the arrow 38, as can be seen in FIG. 1.

Figure 3:
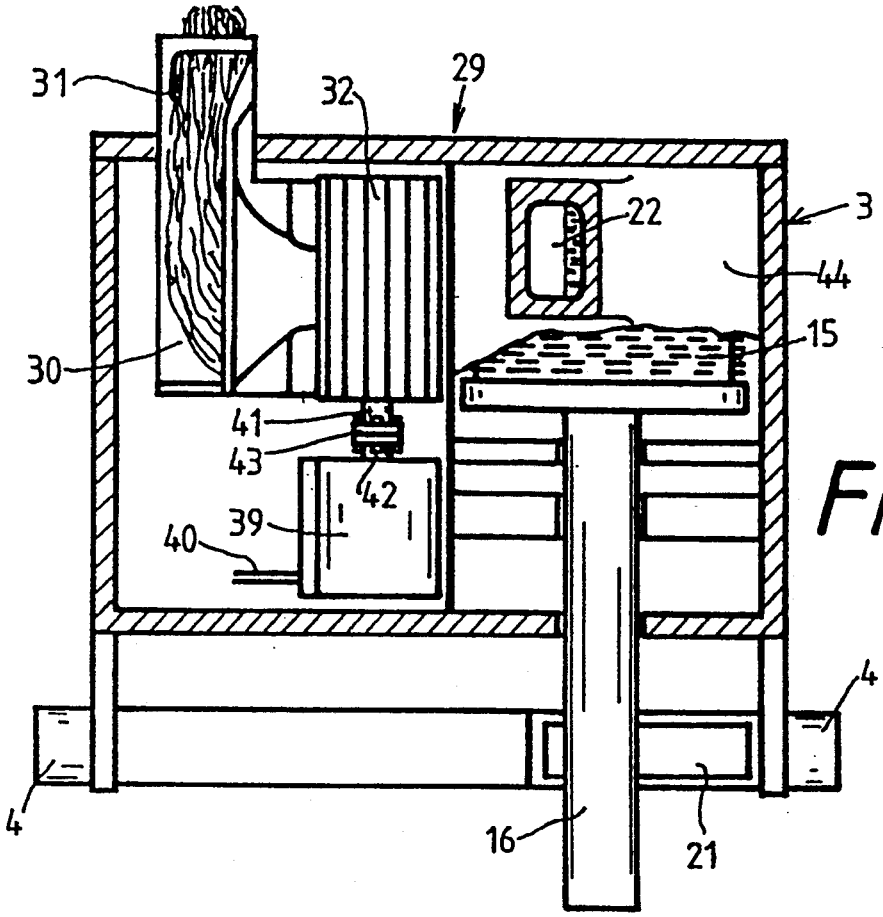
FIG. 3 is a cross-section through the housing cover of the spinning station of FIG. 1 taken along line III—III thereof.

FIG. 3 shows that the individual stepping drive motor 39 is disposed in axial alignment with and behind the drawing-in roller 32. The stepping motor 39 is connected to a control unit (not shown) via electrical leads 40. The drive shaft 41 of the drawing-in roller 32 is connected directly to the drive shaft 42 of the stepping drive motor 39, via a rigid coupling 43, e.g., a flange connection as shown, which serves to make it easier to replace one of the two functional elements. Alternatively, the motor could be affixed directly on the drive shaft of the drawing-in roller.

Figure 4:
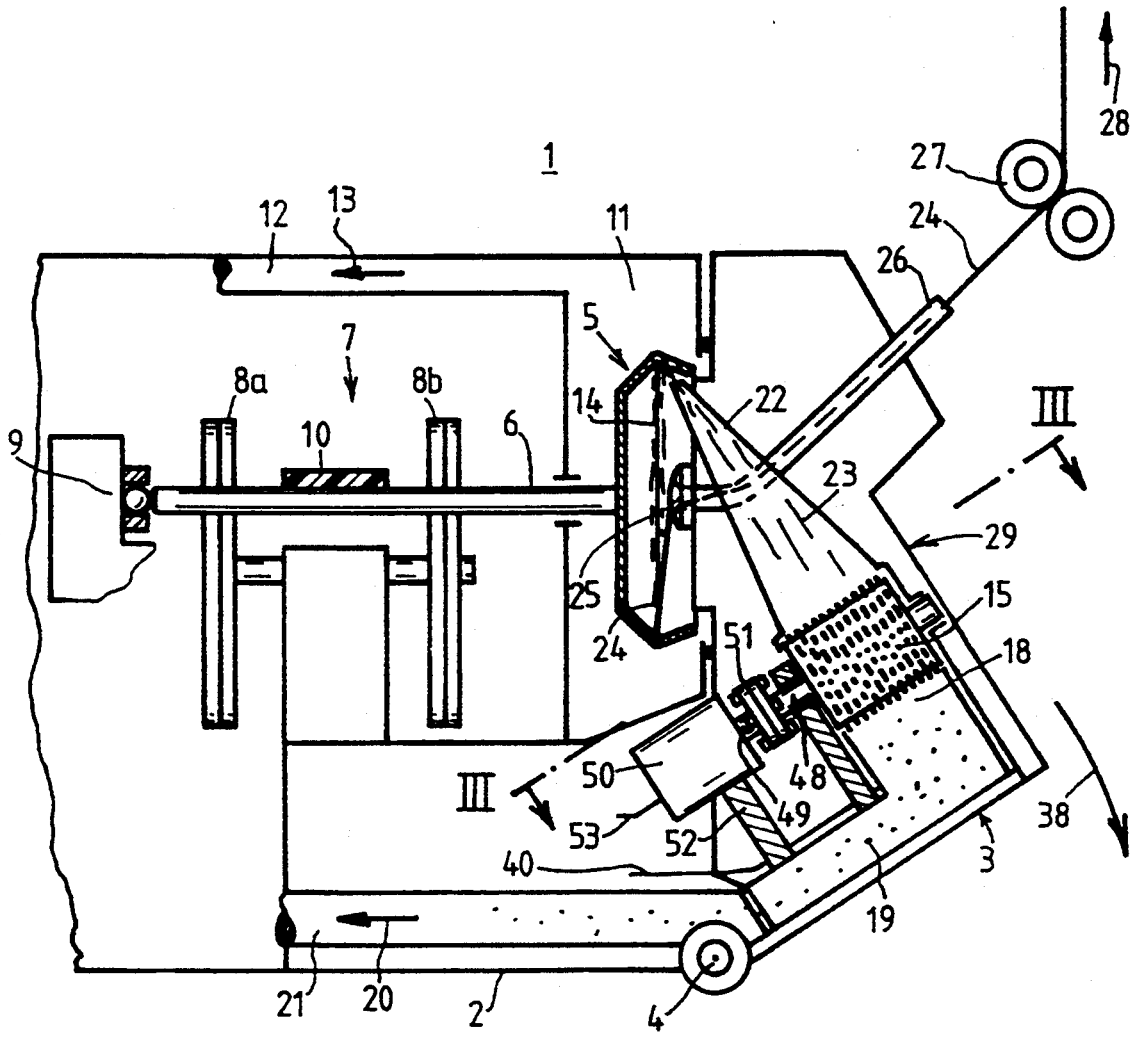
FIG. 4 is a schematic cross-section similar to FIG. 1 of another rotor spinning station according to another embodiment of the present invention equipped with an individual drive for the opening roller.

In the alternative embodiment of FIG. 4, an individual drive motor 50 for the opening roller 15 is also provided instead of the common drive belt 17 shown in FIG. 1. In this case, the drive shaft 48 of the opening roller 15 is connected directly to the drive shaft 49 of the motor 50 via a rigid connection 51, for instance a flange connection. The motor 50 is mounted to a wall portion 52 affixed to the cover 3 and is connected to a control unit (not shown) via an electrical lead 53.

Figure 5:
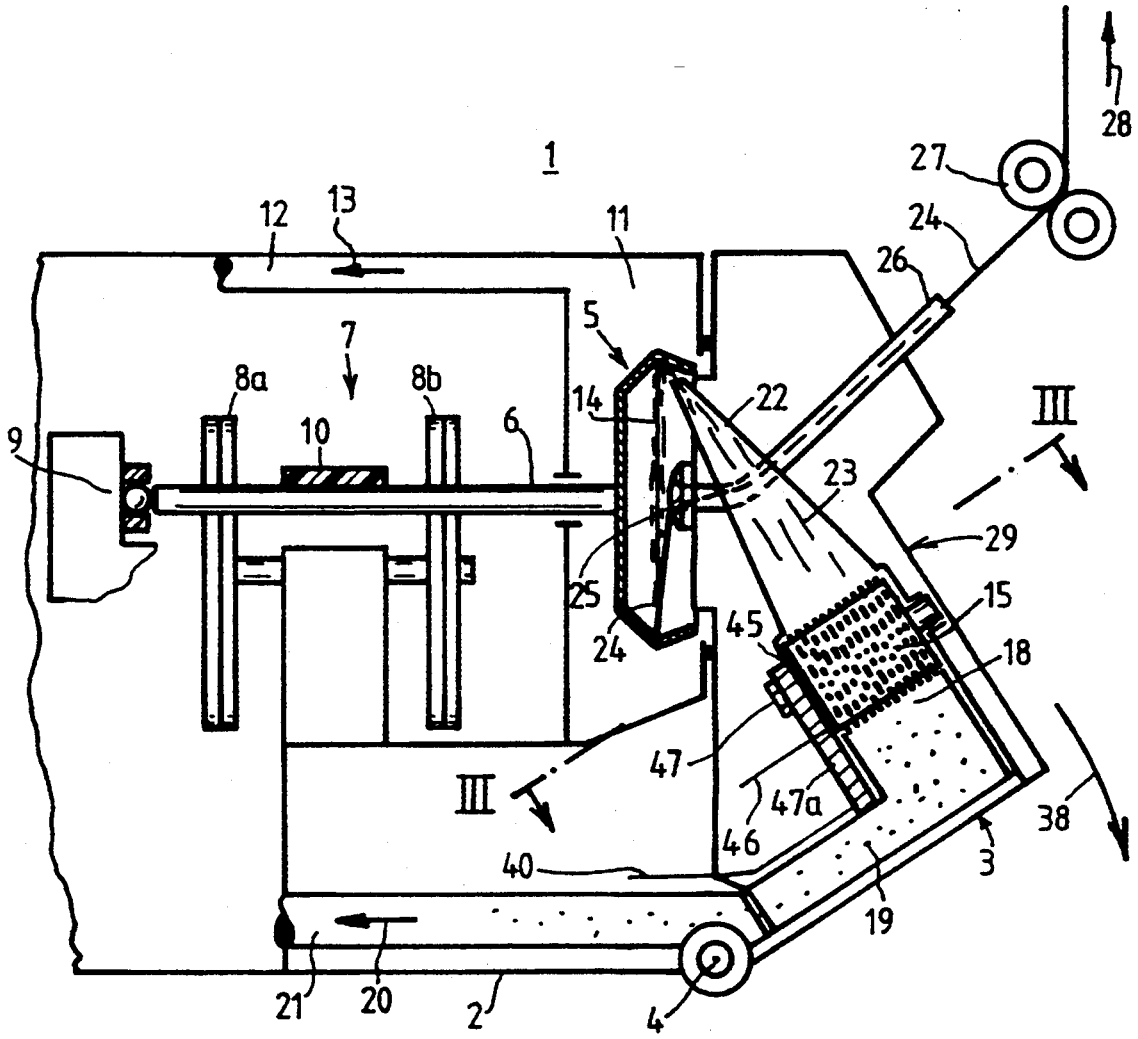
FIG. 5 is another schematic cross-section similar to FIGS. 1 and 4 of another rotor spinning station according to another embodiment of the present invention in which the individual drive of the opening roller is embodied as an electric motor of the type having an outer rotationally driven rotor.

In the further embodiment of FIG. 5, the individual drive for the opening roller 15 is an electrical motor 45 of the type having a stationary central drive unit and a driven exterior rotor coaxially about the stationary drive unit, rather than an output drive shaft per se.

An annular covering of card clothing 15a is attached to the driven rotor of the motor 45 to serve as the opening roller for the sliver 31. The stationary drive unit of the motor 45 is therefore located inside the card clothing 15a and is secured to a wall portion 47a of the cover 3 by fasteners, such as screws 47. The motor 45 is connected to a control unit (not shown) via an electrical lead 46.

Figure 6:
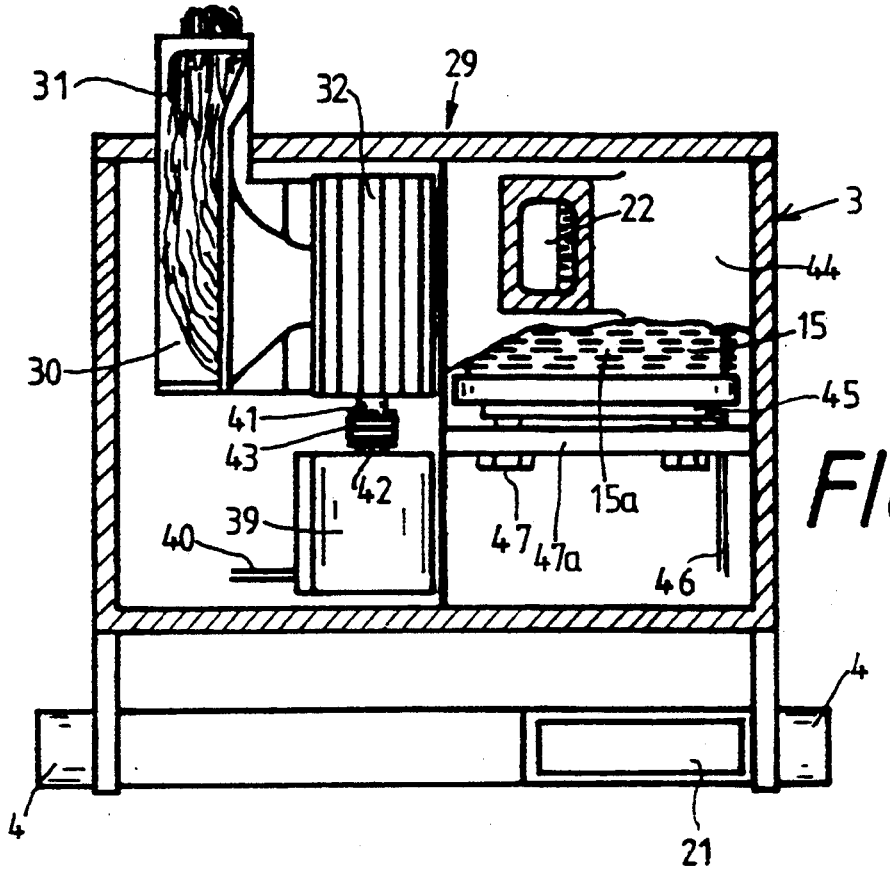
FIG. 6 is a cross-section through the housing cover of the spinning station of FIG. 5, taken along line III—III thereof.

FIG. 6 is a sectional view of the spinning station of FIG. 5 with the cover 3 broken away along line III—III as in FIG. 3. As will be seen, in comparison to the embodiment of FIG. 3, the elimination of the drive shaft 16 of the opening roller resulting from use of the rotor-type driven motor 45 provides an advantageously compact design.

The mounting of the described operational components in the cover 3 is accomplished by a modular connection system. That is, each of the condenser 30, the drawing-in roller 32, its drive motor 39, the opening roller 15 with its drive shaft 16 or with the possible individual drive motors 45,50, and the fiber guide conduit 22 are installed in the cover via plug-type or screw connections (not shown) in appropriate manners enabling them to be detached and removed individually, thereby providing easy accessibility and maintenance.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A rotor yarn spinning machine having a spinning station comprising:

a housing having an openable cover for selective access into the housing, and a spinning rotor, an opening roller, a drawing-in roller for feeding a sliver to the opening roller, and a motor for rotating the drawing-in roller, each disposed in the housing, the drawing-in roller and the motor being connected directly to one another, and the motor being supported by the cover of the housing.

2. The rotor yarn spinning machine of claim 1, wherein the motor is a stepping motor.

3. The rotor yarn spinning machine of claim 2, wherein the stepping motor is controllable for individual feeding of the sliver.

4. The rotor yarn spinning machine of claim 1, further comprising a second drive connected directly to the opening roller, the second drive being supported by the cover of the housing.

5. The rotor yarn spinning machine of claim 4, wherein the drive of the opening roller comprises a driven rotor and the opening roller comprises a layer of card clothing attached to the rotor.

* * * * *